United States Patent [19]

Kruse et al.

[11] 3,956,870

[45] May 18, 1976

[54] MACHINE FOR PACKING CIGARETTES OR THE LIKE

[75] Inventors: Friedel Kruse, Hamburg; Günter Wahle, Reinbek; Otto Erdmann, Hamburg; Willy Rudszinat, Dassendorf, all of Germany

[73] Assignee: Hauni-Werke Korber & Co., KG, Hamburg, Germany

[22] Filed: Dec. 4, 1974

[21] Appl. No.: 529,485

[30] Foreign Application Priority Data

Dec. 17, 1973 Germany ..... 2362771

[52] U.S. Cl. ..... 53/55; 53/63; 53/67; 53/234; 93/12 C

[51] Int. Cl.[2] ..... B65B 11/32; B65B 57/06

[58] Field of Search ..... 53/26, 55, 59, 63, 67, 53/234; 93/12 C; 10/155 A

[56] References Cited

UNITED STATES PATENTS

| | | | |
|---|---|---|---|
| 1,717,403 | 6/1929 | Popov | 53/63 |
| 2,927,333 | 3/1960 | Stern | 10/155 A |
| 2,934,869 | 5/1960 | Engleson | 53/67 X |
| 2,991,603 | 7/1961 | Zuercher | 53/59 R X |
| 3,253,385 | 5/1966 | Beerman | 53/55 |
| 3,385,176 | 5/1968 | Whitaker | 53/234 X |
| 3,802,325 | 4/1974 | Bardenhagen | 93/12 C |
| 3,805,477 | 4/1974 | Kruse | 53/63 X |

*Primary Examiner*—Travis S. McGehee
*Assistant Examiner*—John Sipos
*Attorney, Agent, or Firm*—Peter K. Kontler; John Kurucz

[57] ABSTRACT

A packing machine wherein a first feeding unit supplies groups of cigarettes into successive mandrels of a first turret which is driven stepwise and moves successive mandrels into register with first and second supplying devices for tinfoil blanks and paper blanks which are thereupon draped around the mandrels to form open-ended packs. The packs and the groups of cigarettes are transferred simultaneously from successive mandrels into successive pockets of a second turret on which the packs are closed. The path of mandrels is monitored by a series of detectors one of which prevents the transfer of groups into the pockets of the second turret if the groups are not surrounded by open-ended packs, another of which prevents the first supplying device from delivering a tinfoil blank when the mandrel which approaches the first supplying device does not contain a group, and a third of which prevents the second supplying device from delivering a paper blank when the mandrel which approaches the second supplying device does not carry a tinfoil blank. A fourth detector prevents the admission of a group into the mandrel which remains filled because it was devoid of blanks during transport past the transfer station between the first and second turrets.

16 Claims, 9 Drawing Figures

MACHINE FOR PACKING CIGARETTES OR THE LIKE

BACKGROUND OF THE INVENTION

The present invention relates to the packing of cigarettes or the like, and more particularly to improvements in a machine for confining blocks or groups of cigarettes, cigars, cigarillos or analogous rod-shaped smokers' products in one or more envelopes which may constitute soft or flip-top packs.

It is already known to pack blocks of cigarettes in a machine wherein the blocks are fed seriatim into a first portion of a predetermined path, blanks for the making of envelopes are fed into a second portion of the same path, and blanks for the making of additional envelopes are fed into a third portion of the same path if each pack includes more than one envelope. The blocks and the associated blanks are thereupon moved together whereby the blanks undergo a series of deforming treatments to be converted into envelopes each of which has an open end. The assemblies of blocks and envelopes are thereupon transferred into a second path wherein the open ends of envelopes are closed. It is also known to monitor the first path for the presence or absence of blocks and to admit a blank only when the thus admitted blank is certain to be assembled with a block. Reference may be had to the commonly owned U.S. Pat. No. 3,750,676 to Kruse et al or to the commonly owned German Offenlegungs schrift No. 2,049,984.

The patent to Kruse et al further discloses a machine wherein empty packs (each having an open end) are assembled during travel of blanks along a first path and the empty packs are thereupon transferred into a second path only if they are certain to receive blocks of cigarettes. The blocks are fed by a compacting conveyor which receives blocks from a block forming device. The transfer of an empty pack from the first into the second path is prevented if the pack is incomplete, e.g., when it consists of one instead of several envelopes. The block which was intended to be introduced into an incomplete pack is expelled from its receptacle and its components (cigarettes) are returned to the magazine of the packing machine or broken up to recover the tobacco shreds.

The just discussed machine exhibits the advantage that empty packs are not wasted and also that an empty pack cannot enter that portion of the machine wherein its presence could lead to malfunctions and eventual interruption of operation. As a rule, the making of empty packs is interrupted in automatic response to an interruption of the feed of blocks of cigarettes. The empty packs which fail to receive cigarette blocks, the blocks which are not introduced into packs, and/or the packs which failed to receive blocks due to incompleteness must be collected, the envelopes removed by hand, the thus removed envelopes discarded, and the cigarettes manually returned into the magazine of the packing machine. It has been found that such procedure invariably results in damage to a large number of cigarettes, mainly due to escape of tobacco shreds at the ends of tobacco fillers. Therefore, when a cigarette wherein the density of the end portion of the tobacco filler is unsatisfactory advances beyond the customary testing unit which monitors the heads of cigarettes in successive blocks for the quality of the ends of tobacco fillers, the corresponding block is rejected and, if its cigarettes are reintroduced into the magazine of the packing machine, the rejection can be repeated several times until the cigarettes are sufficiently deformed to be detectable with the naked eye. Furthermore, defective cigarettes in a block which has been segregated by the just discussed testing unit are likely to be divided among several blocks each of which is thereupon segregated due to defectiveness of one or more of its components.

SUMMARY OF THE INVENTION

An object of the invention is to provide a novel and improved machine for transporting and manipulating commodities in packing machines for cigarettes or analogous rod-shaped articles in such a way that the commodities to be packed as well as the commodities which are to be converted into containers for the commodities to be packed are not wasted, that the malfunctioning of one or more units or parts of the machine does not and cannot result in ejection or destruction of satisfactory commodities and/or in recycling of defective commodities, and that the machine invariably turns out containers which are in an optimum condition for further processing, such as for the application of revenue labels, draping into transparent outer envelopes with or without tear strips, introduction into cartons, baling, or transport into storage.

Another object of the invention is to provide a machine for transporting and manipulating blocks of rod-shaped smokers' products and blanks which are to be converted into containers for rod-shaped products wherein each and every blank which has been removed from its source is converted into a portion of a container and wherein each and every block which has been admitted into the path wherein it is to be assembled with containers invariably enters and is properly confined in a container.

A further object of the invention is to provide novel and improved means for regulating the admission of commodities into and their transport in paths wherein such commodities are converted into soft or flip-top packs for cigarettes, cigars or cigarillos.

An additional object of the invention is to provide a packing machine for cigarettes or analogous rod-shaped smokers' products whose operation is more economical and necessitates less supervision than the operation of heretofore known packing machines.

A feature of the invention resides in the provision of a machine for manipulating commodities forming part of packs containing cigarettes or analogous rod-shaped articles, especially a machine for manipulating groups of parallel cigarettes, cigars or cigarillos together with components of containers for such groups to form packaged goods in the form of closed, sealed, labelled and cellophane-wrapped packs for rod-shaped smokers' products. The machine comprises means for feeding a first series of first commodities from a first source into a first portion of a first path, means for advancing the series of first commodities along the first path, means for feeding a second series of second commodities from a second source into a second portion of the first path so that each commodity of the first series is normally assembled or paired with and advances with a commodity of the second series along the first path, means for transferring successive pairs of first and second commodities from a third portion of the first path into a second path, means for monitoring the first path (preferably between the second and third portions of the first path) to detect the presence of commodities which form part of one of the series and are not paired or associated with commodities of the other series, means for transferring unpaired commodities of the one series from the first path into a third path, means for advancing the commodities of the one series along the third path into the second portion of the first path, and means for interrupting the feeding of a commodity of the one series from the respective source into the corresponding portion of the first path for each unpaired commodity in the third path so that the unpaired commodities form part of the one series in the first path. Such machine eliminates losses in commodities of the one series because each commodity of the one series which is not paired with a commodity of the other series is returned into the first path so that it can be paired with a commodity of the other series during renewed travel along the first path.

The commodities of the one series perferably constitute the goods to be packed (e.g., blocks or arrays of five, ten, twenty or twentyone cigarettes each), and the commodities of the other series then constitute components of containers for such goods (such components may constitute metallic or paper blanks which are to be converted into inner or outer envelopes of cigarette packs).

The machine preferably further comprises means for monitoring the first path to detect the absence of first commodities between the first and second portions of the first path, and means for interrupting the feeding of a second commodity into the second portion of the first path in response to detected absence of a first commodity so that a second commodity is admitted into the first path only when it meets a first commodity. Such construction insures additional savings in commodites because, if the first commodities are blocks of cigarettes and the second commodities are metallic or paper blanks, the blanks are admitted into the first path only and alone if each thereof is certain to meet and to be properly paired with a block.

The blanks are subjected to at least one deforming treatment (to be converted into envelopes forming part of cigarette packs or analogous containers for smokers' products) in each of the first and second paths.

If each commodity of the one series consists of a group of parallel rod-shaped articles, the machine preferably further comprises means for forming successive groups of rod-shaped articles at the rate at which the groups are being fed into the respective portion of the first path. The interrupting means then comprises means for discontinuing the group forming steps so as to provide in the one series a gap for each commodity in the third path.

In accordance with a feature of the invention which contributes to simplicity and compactness of the packing machine, the first and third paths form a single endless path and the third path preferably merges into the first portion of the first path, i.e., each commodity of the one series which is to return into the second portion of the first path must pass through the first portion of the first path.

In order to simplify the controls of the packing machine, the one series is preferably the first series (i.e., the commodities which constitute groups of rod-shaped articles are preferably fed into the first portion of the first path) and the first portion of the first path is located ahead of the second portion, as considered in the direction in which the commodities advance along the first path.

The machine may comprise means for feeding a third series of (third) commodities into a fourth portion of the first path intermediate the second and third portions of the first path so that each pair of associated first and second commodities is normally further associated and advances with a third commodity (each third commodity may constitute a blank which is to be converted into the outer envelope of a cigarette pack or an analogous container for groups or blocks of rod-shaped smokers' products). Thus, each third commodity may constitute a second component of a container for the goods to be packed. The just described machine preferably further comprises means for monitoring the first path between the second and fourth portions of the first path to detect the absence of pairs of first and second commodities, and means for interrupting the feeding of a third commodity into the fourth portion of the first path in response to detected absence of a pair of first and second commodites between the second and fourth portions of the first path. Alternatively, the just described machine may comprise means for monitoring the first path between the second and fourth portions of the first path to detect the absence of commodities of the other series, and means for interrupting the feeding of a third commodity into the fourth portion of the first path in response to detected absence of a commodity of the other series.

The second monitoring means (to detect the absence of commodities of the one series) is preferably disposed at a locus immediately ahead of the second portion of the first path, as considered in the direction in which the first commodities advance along the first path.

The advancing means preferably comprises means for moving the commodities stepwise along the first path so that first intervals of movement alternate with second intervals of dwell or idleness of commodities in the first path. Each step of subjecting a commodity of the other series (i.e., a blank) in the first path to a deforming treatment (such as draping, tucking and/or folding) is preferably performed during a period of time which is not longer than the combined duration of a first and a second interval.

The novel features which are considered as characteristic of the invention are set forth in particular in the appended claims. The improved packing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1A:
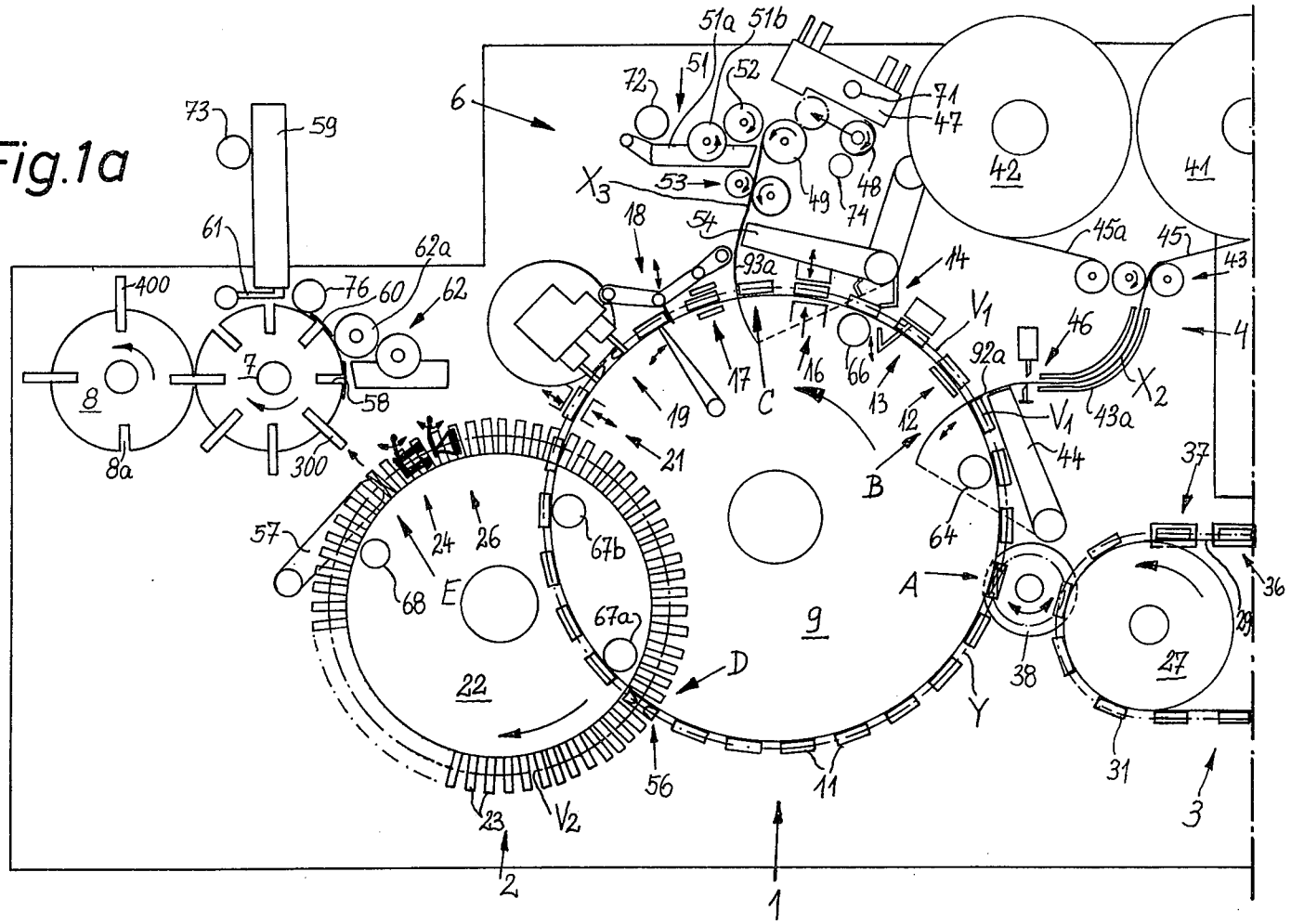
FIG. 1*a* is a schematic elevational view of a portion of a cigarette packing machine which embodies the invention.
Figures 1B, 4, 5, 6:
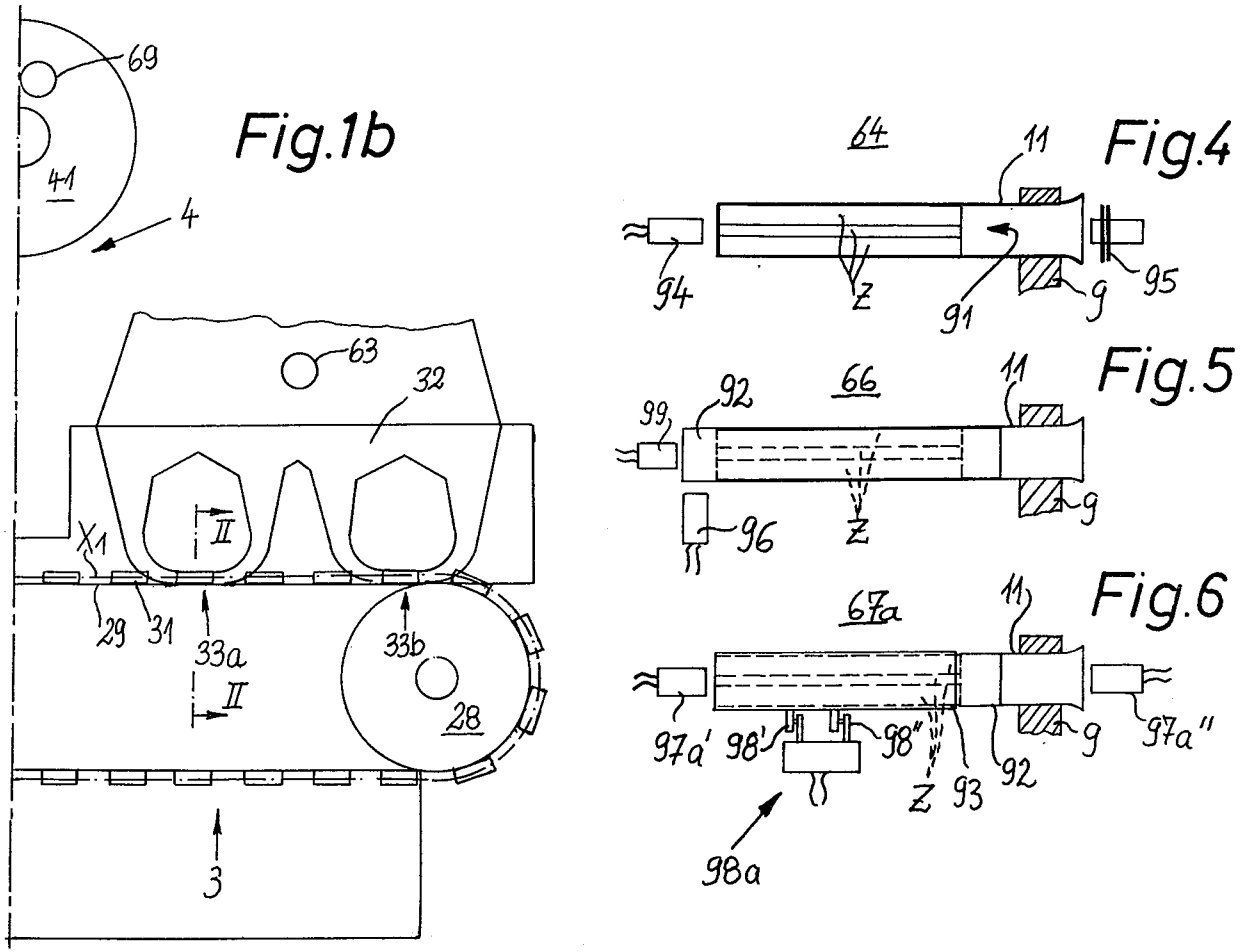
FIG. 1*b* is a similar schematic elevational view of the remaining portion of the packing machine.
FIG. 4 is a fragmentary sectional view of a turret for mandrels which transport blocks of cigarettes and a schematic elevational view of a first detector which is utilized in the packing machine to monitor the first path for the presence or absence of blocks in successive mandrels.
FIG. 5 is a similar sectional view of the turret and a schematic elevational view of a second detector.
FIG. 6 is a similar sectional view of the turret and a schematic elevational view of a third detector.

Referring first to FIGS. 1*a* and 1*b*, there is shown a packing machine for plain or filter-tipped cigarettes Z (see FIGS. 2–6). The packing machine comprises an endless conveyor 1 here shown as including a turret 9 which is rotatable about a horizontal axis and has an annulus of equally spaced hollow mandrels 11. Each mandrel 11 has a rectangular cross-sectional outline and is open at both ends; its interior is dimensioned to accommodate a block or group 91 (FIGS. 3–4) consisting of a predetermined number (e.g., twentyone) cigarettes Z. The two open ends of each mandrel 11 respectively face toward and away from the observer of FIG. 1*a*. The conveyor 1 is actually a functional equivalent of two conveyors one of which serves to transport blocks 91 of cigarettes Z from a path portion or transfer station A to the path portion or transfer station D, and the other of which serves to transport certain blocks 91 from the transfer station D back to the transfer station A.

A second conveyor 2 of the packing machine is partially overlapped by the turret 9 and comprises a turret 22 which is rotatable about a horizontal axis parallel to the axis of the turret 9. The turret 22 carries an annulus of equally spaced receptacles or pockets 23 each of which can receive a partially finished pack including a block 91 of cigarettes Z, an inner envelope 92 (FIGS. 3, 5, 6) consisting of metallic foil (e.g. tinfoil) and an outer envelope 93 (FIGS. 3, 6) consisting of paper or cardboard. The pockets 23 receive partly finished packs from the turret 9 at the transfer station D.

A first feeding unit 3 of the packing machine serves to normally supply an uninterrupted series of blocks 91 consisting of cigarettes Z to successive empty mandrels 11 at the transfer station A. A second feeding unit 4 is provided to normally deliver an uninterrupted series of tinfoil blanks 92*a* (FIG. 1*a*) to successive mandrels 11 at a path portion or transfer station B which is located downstream of the transfer station A, and a third feeding unit 6 is provided to normally deliver an uninterrupted series of paper or cardboard blanks 93*a* (hereinafter referred to as paper blanks) to successive mandrels 11 at a path portion or transfer station C which is located downstream of the station B but upstream of the station D.

Containers or packs 300 whose envelopes 92, 93 are closed at both ends are removed from successive pockets 23 of the turret 22 at a transfer station E to be introduced into successive slots or sockets 58 of a turret 7 forming part of a labelling device which serves to apply an adhesive-coated revenue label 60 to one end of each pack 300. The labelled packs 400 are transferred into the slots 8a of a turret 8 forming part of a reorienting device which changes the orientation of each pack 400 by 90 degrees and delivers successive packs onto the upper stretch of an endless conveyor belt (not shown) or the like for transport to a carton filling machine or to a machine which provides each pack 400 with an outermost envelope consisting of transparent synthetic plastic material and normally provided with a customary tear strip.

In the following part of this description, the mechanical details of the packing machine will be outlined only to the extent which is necessary for full understanding of the invention. All such components of the packing machine which are not fully shown or described are preferably similar to or identical with those described in the aforementioned German Offenlegungsschrift No. 2,049,984 and U.S. Pat. No. 3,750,676 to Kruse et al.

The mandrels 11 transport blocks 91 of cigarettes Z, tinfoil blanks 92*a* and paper blanks 93*a* past a series of draping, tucking and folding devices 12, 13, 14, 16, 17, 18, 19 and 21 which are adjacent to the path movement of mandrels between the transfer stations B and D. The devices 12, 13, 14 and 16 treat the blanks 92*a* and comprise means for converting such blanks into envelopes 92 each of which surrounds five sides of the respective mandrel 11 but is open at one end. It can be said that each of the devices 12–14 and 16 subjects successive tinfoil blanks 92*a* to at least one deforming treatment whereby the device 12 preferably serves to convert an originally rectangular blank 92*a* into a U-shaped body surrounding the respective mandrel at three sides, the device 13 thereupon converts the U-shaped body into a tube surrounding the respective mandrel at four sides, the device 14 thereupon partially closes one end of the tubular body by tucking in the narrower sides of the tube portion extending beyond one end of the mandrel, and the device 16 completes the closing of the one end of the tubular body by folding the two wider sides so that the tubular body is converted into an open-ended envelope 92.

The devices 17, 18, 19 and 21 serve to subject successive paper blanks 93*a* to a similar treatment, i.e., they convert originally flat sheet-like rectangular or substantially rectangular blanks 93*a* first into U-shaped bodies, thereupon into tubes, then into tubes each having a partially closed end and an open end, and finally into tubes each having a fully closed end and an open end. The resulting envelopes 93 surround the respective envelopes 92 and the envelopes 92 surround five sides of the respective mandrels 11 (including the four walls or panels of the respective mandrel and an open end of such mandrel). The other open end of the mandrel is located at the opposite side of the turret 9 (see FIGS. 3–6).

Figure 3:
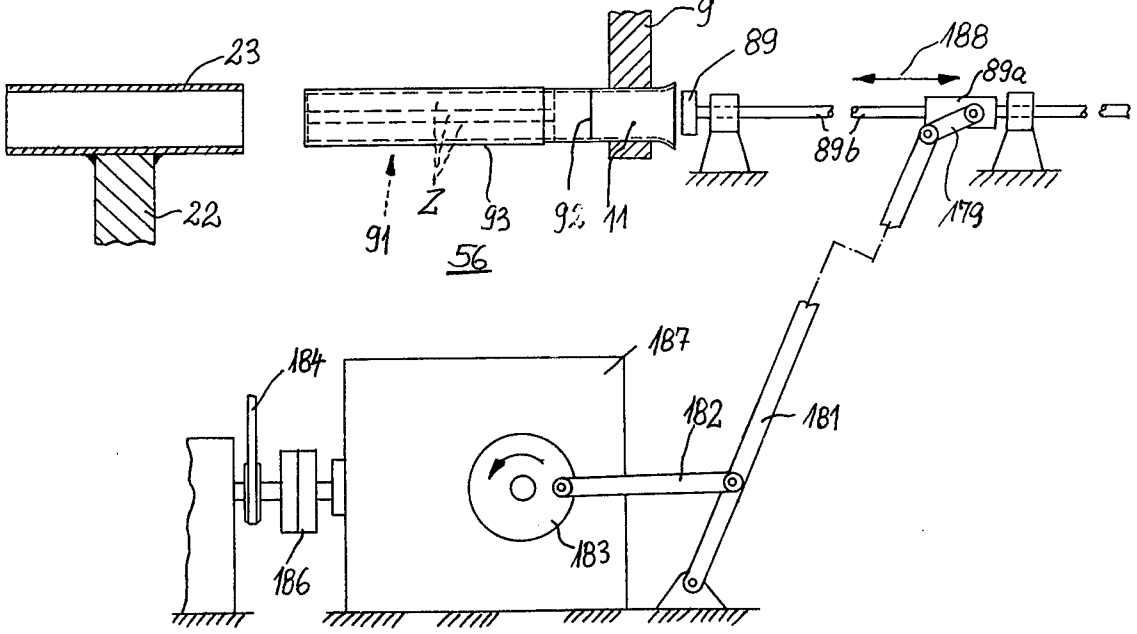
FIG. 3 is a similar sectional view of a block transferring device which is located at a transfer station D shown in FIG. 1*a*.

As shown in FIG. 3, a block or group 91 can be expelled from its mandrel 11 by a reciprocable pusher 89 which forms part of a transferring device 56 at the transfer station D. The pusher 89 can engage the exposed ends of cigarettes Z which form the block 91 and, while advancing in a direction to the left, as viewed in FIG. 3, pushes the block 91 into the registering pocket 23 of the turret 22. The leading ends of the cigarettes Z then strip the envelopes 92, 93 off the respective mandrel 11 and cause the major portions of both envelopes to enter the pocket 23. Thus, each pocket 23 normally receives a partially finished pack including a block 91, an inner envelope 92 consisting of tinfoil (open at one end) and an outer envelope 93 consisting of paper (also open at one end).

During transport with the pockets 23, the partly finished packs advance past two additional deforming devices 24, 26 the first of which constitutes a means for tucking and the second of which constitutes a means for folding flaps at the open ends of the envelopes 92 and 93. Each pack 300 which advances beyond the device 26 is closed at both ends and is ready for introduction into a socket 58 of the turret 7 in the labelling device.

Figure 2:
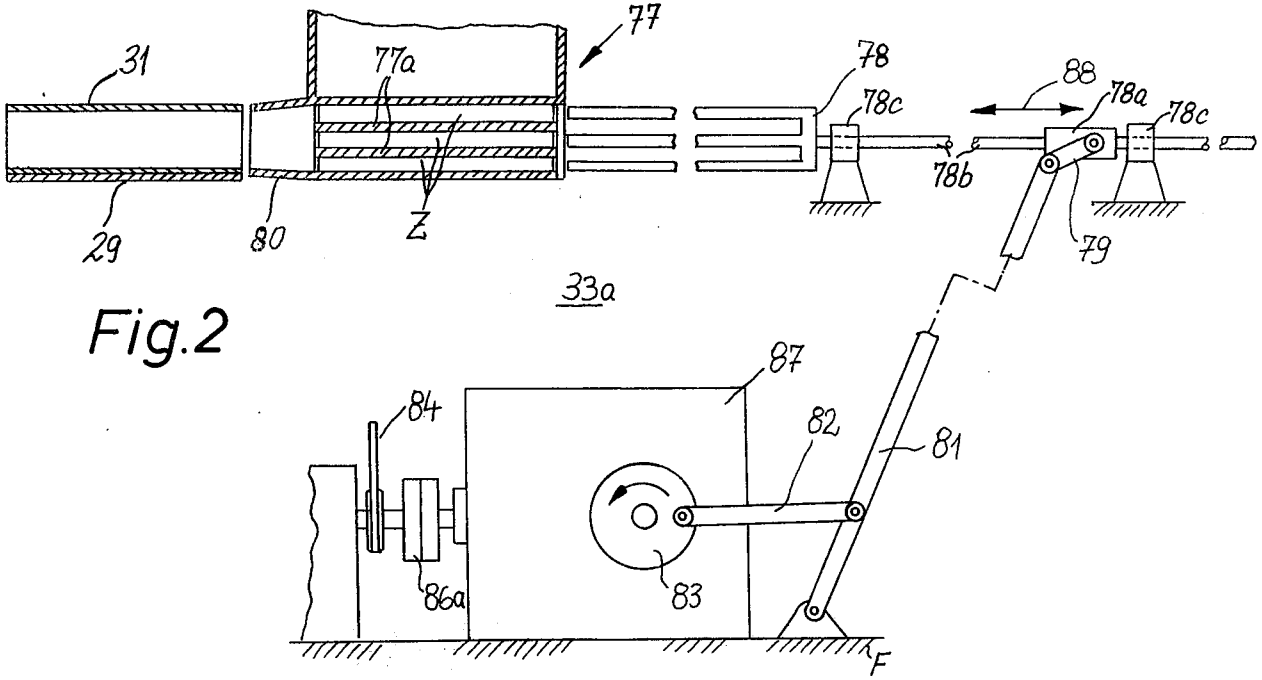
FIG. 2 is an enlarged sectional view of a block forming device in a block feeding unit of the packing machine, substantially as seen in the direction of arrows from the line II—II of FIG. 1*b*.

The first feeding unit 3 comprises an endless flexible element 29 (e.g., a chain or a flat or toothed belt) which is trained over sprocket wheels or pulleys 27, 28 and carries a set of equally spaced cells or receptacles 31 each of which can receive a block 91. The feeding unit 3 further comprises a magazine or hopper 32 (see FIG. 1*b*) which constitutes a source of supply of parallel cigarettes Z received from a filter cigarette making machine or from a machine for the making of plain cigarettes, preferably through the medium of a variable-volume magazine (not shown) which is mounted above the hopper 32 and serves to insure that the packing machine can remain in operation, at least for a certain period of time, subsequent to stoppage of the maker (machine for the making of plain or filter cigarettes) or that the maker can remain in operation after stoppage of the packing machine. Still further, the feeding unit 3 comprises two block forming devices 33*a*, 33*b* which are adjacent to the upper stretch of the flexible element 29 upstream of the transfer station A and have means for accumulating blocks 91 for introducing such blocks into the adjacent empty receptacles 31. The details of the block forming device 33*a* are shown in FIG. 2.

Blocks 91 which are confined in the receptacles 31 of the feeding unit 3 are caused to move past a testing unit 36 which comprises means for determining the density of tobacco fillers at the ends of the cigarettes Z and for transmitting a signal to an ejecting unit 37 in response to detection of a block 91 having one or more cigarettes Z with defective tobacco fillers. The details of a testing unit which can be used in the feeding unit 3 of FIGS. 1*a* and 1*b* are disclosed, for example, in German Offenlegungsschrift No. 1,511,782. The testing unit 36 is preferably designed in such a way that it can also detect the absence of one or more cigarettes Z in a block 91, and such detection also results in expulsion of the corresponding block from its receptacle 31 while the receptacle registers with the ejecting unit 37. Cigarettes Z with defective tobacco fillers are transported to an apparatus which recovers tobacco shreds for renewed use, and cigarettes Z which are satisfactory but form part of incomplete blocks 91 are preferably returned into the hopper 32 or into the aforementioned variable-volume magazine above the hopper 32.

Satisfactory blocks 91 (i.e., those which are premitted to advance beyond the ejecting unit 37) are introduced into one of two pockets of an oscillatory condensing or compacting conveyor 38. The latter can turn back and forth through about 180° so that one of its pockets registers with a receptacle 31 on the endless flexible element 29 while the other pocket registers with a mandrel 11 at the transfer station A, or vice versa. The crosssectional area of each pocket of the condensing conveyor 38 is less than the cross-sectional area of a block 91 in its receptacle 31, i.e., the blocks must be compacted in order to fit into the pockets of the conveyor 38 whereby their dimensions are reduced sufficiently to fit into the mandrels 11. The provision of a condensing conveyor in a packing machine for cigarettes or the like is a well known expedient; the main purpose of compacting is to eliminate eventual deviations of the dimensions of a block 91 (as it is formed by the device 33*a* or 33*b*) from a predetermined norm and to insure that the cigarettes Z in the mandrels 11 and pockets 23 are at least slightly compacted so that they are less likely to lose tobacco shreds at the ends.

The second feeding unit 4 comprises an expiring bobbin 41 which constitutes a source of supply of convoluted web 45 consisting of tinfoil or another suitable metallic sheet stock. The feeding unit 4 further comprises means for supporting a fresh bobbin 42 in a position of readiness so that the leader of its web 45*a* can be spliced to the trailing end of the web 45 when the supply of web 45 on the bobbin 41 is about to expire.

The web 45 is advanced stepwise by two advancing rolls 43 and passes through an arcuate guide 43*a* and thereupon between the knives of a severing device 46. When the device 46 is actuated to sever the web 45, the separated portion of the leader of the web 45 constitutes a metallic blank 92*a* which is attracted by suction to the adjacent surface or mechanically held by the claws or jaws of an oscillatory blank supplying device 44. The device 44 can pivot between the solid-line and broken-line positions of FIG. 1*a*. When in the solid-line position, the device 44 attracts or holds the foremost end of the web 45 and thereupon pivots to the broken-line position so as to move the leader of the web 45 in front of a mandrel 11 at the transfer station B. The device 46 thereupon severs the web 45 whereby the web portion between the device 44 (in broken-line position) and the severing device 46 constitutes a blank 92*a* which is entrained by the mandrel 11 when the latter is caused to advance beyond the transfer station B. The turret 9 is driven stepwise so that a mandrel 11 always dwells at each of the transfer stations A, B, C, D during each interval of idleness and that each mandrel advances by a step during the next-following interval of rotation of the turret 9. For example, the turret 9 will be indexed three times in order to advance a mandrel 11 from the transfer station A to the transfer station B, five times to advance a mandrel from the station B to the station C, ten times to advance a mandrel from the station C to the station D, and eight times to advance a mandrel from the station D back to the station A.

The third feeding unit 6 comprises a magazine 47 for a stack of prefabricated paper blanks 93*a*. The lowermost or the rightmost blank 93*a* of the stack can be removed by a rotary suction wheel 48 which is movable sideways between the solid-line and phantom-line positions of FIG. 1*a*. When in the solid-line position, the suction wheel 48 can withdraw a blank 93*a* from the magazine 47, and the wheel 48 is thereupon moved to the phantom-line position to deliver the blank 93*a* to a suction drum 49 which cooperates with a rotary drum-shaped applicator 52 forming part of a paster 51. The latter further comprises a tank 51*a* for a supply of adhesive and a roller 51*b* which dips into the supply of adhesive and applies films of adhesive to selected portions of the suitably profiled applicator 52 so that the applicator can apply adhesive to selected portions of successive paper blanks 93*a*, namely to those portions of paper blanks which are to overlap and adhere to each other when the blanks 93*a* are converted into envelopes 93. The adhesive-coated blanks 93*a* are moved forwardly by two advancing rolls 53 which move the leaders of successive blanks 93*a* into the range of a blank supplying device 54 similar or analogous to the aforementioned blank supplying device 44 in the feeding unit 4. It is assumed that each of the devices 44, 54 is or resembles tongs having claws or jaws which can mechanically grip the leaders of successive blanks 92*a*, 93*a* and thereupon pivot to the respective broken-line positions in order to move the blanks in front of the adjacent mandrels 11 (at the stations B and C, respectively).

The transferring device 56 at the station D comprises the aforementioned pusher 89 (FIG. 3) which registers with a mandrel 11 of the turret 9 and also with a pocket 23 of the turret 22 when the conveyors 1 and 2 are at a standstill. The arcuate path along which the blocks 91, blanks 92*a* (envelopes 92) and blanks 93*a* (envelopes 93) respectively advance from the stations A, B, C toward the station D is shown at $V_1$; this path extends along an arc of approximately 225°. The arcuate path along which certain blocks 91 advance from the transfer station D toward the stations A and B is shown at Y, and the arcuate path along which partly finished packs and finished packs 300 advance in the pockets 23 is shown at $V_2$. The path $V_2$ extends along an arc of about 540° because the numbers of mandrels 11 and pockets 23 and the positions of the transfer stations D and E are selected in such a way that a pocket 23 which has received a partly finished pack at the transfer station D bypasses the transfer station E during a first revolution about the axis of the turret 23 but moves into register with a transferring device 57 at the station E during the next-following revolution about such axis. Reference may be had to the commonly owned copending application Ser. No. 450,618 of Harry David filed March 13, 1974 now U.S. Pat. No. 3,922,837. The device 57 is designed to transfer finished (but still unlabelled) packs 300 from the pockets 23 of the turret 22 into the sockets 58 of the turret 7. The transferring device 57 is constructed and operated in such a way that it turns each filled pack 300 in the plane of such pack and through an angle of 90° before the pack 300 enters the adjacent socket 58. The labelling device further comprises an upright magazine 59 for a stack of uncoated revenue labels 60, an arm 61 having one or more suction cups or the like and being movable between a position of register with the lower end of the magazine 59 (to attract the lowermost label 60 of the stack) and a second position in which it places the thus removed label 60 across the open outer end of the adjacent empty socket 58. The periphery of the turret 7 is formed with suction ports (not shown) which attract the end portions of the labels 60. As the turret 7 indexes clockwise, the outer sides of successive labels 60 are coated with adhesive by a roller-shaped applicator 62*a* forming part of a paster 62.

The packing machine comprises a main prime mover 146 (shown in FIG. 8) which drives the turrets 7, 8, 9, 22 and the flexible element 29 in stepwise fashion. Each of the turrets 7, 8, 9 advances by a step, i.e., by a distance corresponding to that between the centers of two neighboring mandrels 11, sockets 58 or slots 8*a*. Also, the flexible element 29 advances by steps equal to the distances between the centers of neighboring receptacles 31. The length of stepwise advances of the turret 22 is different; the length of each such advance is twice the distance between the centers of two neighboring pockets 23. The turret 22 carries an odd number of pockets 23 and the distance between the transfer stations D and E is *m* times *n* wherein *m* is the distance between the centers of two neighboring pockets 23 and *n* is an odd number. This insures that a pocket 23 which registers with the transferring device 56 bypasses the transferring device 57 after an angular displacement of about 180°, that such pocket 23 thereupon moves into register first with the deforming (tucking) device 24 and thereupon into register with the deforming (folding) device 26, that the same pocket thereupon beypasses the transferring device 56, and that such pocket finally moves into register with the transferring device 57. Relatively long periods of travel of partly finished packs and finished packs 300 with the turret 22 are desirable in order to insure that the adhesive applied by the applicator 52 to blanks 93*a* has enough time to set before the respective pack 300 is expelled from its pocket 23.

The path along which the receptacles 31 of the feeding unit 3 transport a series of blocks 91 toward the transfer station A is shown at $X_1$; the path along which the web 45 and the blanks 92*a* move toward the transfer station B is shown at $X_2$; and the path along which the blanks 93*a* move toward the transfer station C is shown at $X_3$. The commodities 91, 92*a*, 93*a* which advance along these paths and along the aforementioned paths $V_1$ and $V_2$ are monitored by a plurality of detectors which are schematically indicated by circles. Certain of these detectors, namely the ones whose exact functioning is important for the understanding of the invention, are shown in greater detail in FIGS. 4 to 7; however, it will be understood that the illustrated detectors can be replaced by other detectors which are capable of performing identical or analogous functions. The detectors include a level detector 63 (preferably including an upper level detector and a lower level detector) which is mounted in or on the hopper 32 of the feeding unit 3 and serves to monitor the quantity of cigarettes Z above the block forming devices 33*a*, 33*b*. If the quantity is excessive, the upper level detector of the detector 63 turns off or reduces the speed of the maker (e.g., a cigarette making machine or a filter cigarette making machine) which supplies cigarettes to the hopper 32. If the detected quantity is too small, the lower level detector of the detector 63 turns off the block forming device 33*a* and/or 33*b*.

A second detector 64 is mounted adjacent to the path $V_1$ immediately upstream of the transfer station B to monitor the mandrels 11 for the presence or absence of blocks 91 therein. The detector 64 can produce signals which are used to interrupt the operation of the feeding unit 4 in response to detection of an empty mandrel 11; this insures that the feeding unit 4 delivers a blank 92*a* into the path of movement of those mandrels 11 which contain blocks 91 of cigarettes Z but not into the path of movement of empty mandrels.

An analogous detector 66 is mounted adjacent to the path $V_1$ between the transfer stations B and C to monitor the mandrels 11 for the presence or absence of blanks 92*a;* in the absence of a blank 92*a* (i.e., in the absence of a block 91 in the adjacent mandrel 11 and in the absence of a blank 92*a* which is partly converted into an envelope 92), the detector 66 transmits a signal which interrupts the operation of the feeding unit 6 so that the latter does not deliver blanks 93*a* into the path of movement of empty mandrels 11.

Two further detectors 67*a*, 67*b* are adjacent to the path $V_1$ between the transfer stations C and D. The detector 67*a* can produce signals to deactivate the transferring device 56 and the block forming device 33*a*, and the detector 67*b* can produce signals to deactivate the block forming device 33*b*.

A detector 68 (e.g., a photoelectric cell) is adjacent to the path $V_2$ upstream of the transfer station E to monitor the packs in the adjacent pockets 23 (namely in each second pocket) and to produce signals when the adjacent pockets 23 contain unfinished packs which are still open at one end. The detector 68 does not detect those (unfinished) packs which are about to be treated by the deforming devices 24, 26 because such packs do not register with the detector 68 when the turret 22 is idle. If a pack which is about to be transferred into an empty socket 58 of the turret 7 is not properly closed at both ends, the detector 68 transmits a signal which deactivates the arm 61 so that the latter does not place a label 60 across that socket 58 which would receive the unfinished pack.

A further detector 69 (preferably a photoelectric cell) monitors the diameter of the expiring bobbin 41 in the feeding unit 4 to produce a signal when the supply of web 45 on the bobbin 41 is about to expire. A similar detector 71 is adjacent to or mounted in the magazine 47 to monitor the quantity of blanks 93*a*. A further detector 72 (e.g., a photoelectric cell identical with 71) monitors the supply of adhesive in the tank 51*a* of the paster 51, and still another detector 73 (preferably a photoelectric cell) monitors the supply of revenue labels 60 in the magazine 59.

The detectors 69, 71, 72 and 73 can produce signals which are utilized to arrest the block forming devices 33*a*, 33*b* when the supply of web 41 has expired, when the magazine 47 is empty or nearly empty, when the supply of paste in the tank 51*a* is below a predetermined level, and when the supply of labels 60 in the magazine 59 is exhausted or nearly exhausted.

A detector 74 (e.g., a vacuum switch) monitors suction in the ports of the drum 49 in the feeding unit 6. A similar detector 76 monitors suction in the ports which are machined into the periphery of the turret 7. The signals from detectors 74, 76 are indicative that the respective units are inoperative and are used to disengage a clutch 147 (driven by the prime mover 146) with a certain delay (see 161 in FIG. 8), preferably in response to detection of two successive malfunctions of the suction generating means which attracts blanks 93*a* to the periphery of the drum 49 and/or of suction generating means which attracts revenue labels 60 to the periphery of the turret 7.

The block forming unit 33*a* of FIG. 2 comprises a duct 77 which receives cigarettes Z from the lower portion of the hopper 32. The duct 77 has two partitions 77*a* which subdivide its interior into three channels into which the cigarettes Z descend by moving sideways. When the flexible element 29 is at a standstill and one of its empty receptacles 31 registers with the duct 77, a three-pronged pusher 78 performs a working stroke (in a direction to left, as viewed in FIG. 2) and expels a block 91 of twentyone cigarettes Z into the receptacle 31. A tapering mouthpiece 80 is adjacent to the discharge end of the duct 77 to guide the cigarettes of a block 91 into the adjacent receptacle 31. The directions in which the pusher 78 is reciprocable by a mechanism which receives motion from the main prime mover 146 are indicated by a double-headed arrow 88. This mechanism comprises a lever 81 which is pivotably mounted in the frame F of the packing machine, a link 79 which connects the free end of the lever 81 to a sleeve 78*a* on a rod 78*b* for the pusher 78, a link 82 which couples an intermediate portion of the lever 81 to a disk 83, a drive 87 whose output element carries the disk 83 and whose input element can be driven by an electromagnetic clutch 86*a*, and a belt transmission 84 which receives motion from the prime mover 146 and drives the input element of the clutch 86. The rod 78*b* is reciprocable in stationary bearing sleeves 78*c*. The transmission 84 preferably employs a toothed belt to prevent slippage. The drive 87 is a conventional transmission which can rotate the disk 83 during each second interval of idleness of the flexible element 29. The block forming device 33*a* is operated simultaneously with the device 33*b* to form pairs of blocks 91 which fill all receptacles 31 travelling toward the transfer station A. Each complete revolution of the disk 83 causes a forward and a return stroke of the pusher 78. The duct 77 is filled with cigarettes Z while the pusher 78 dwells in the retracted position shown in FIG. 2.

Figure 7:
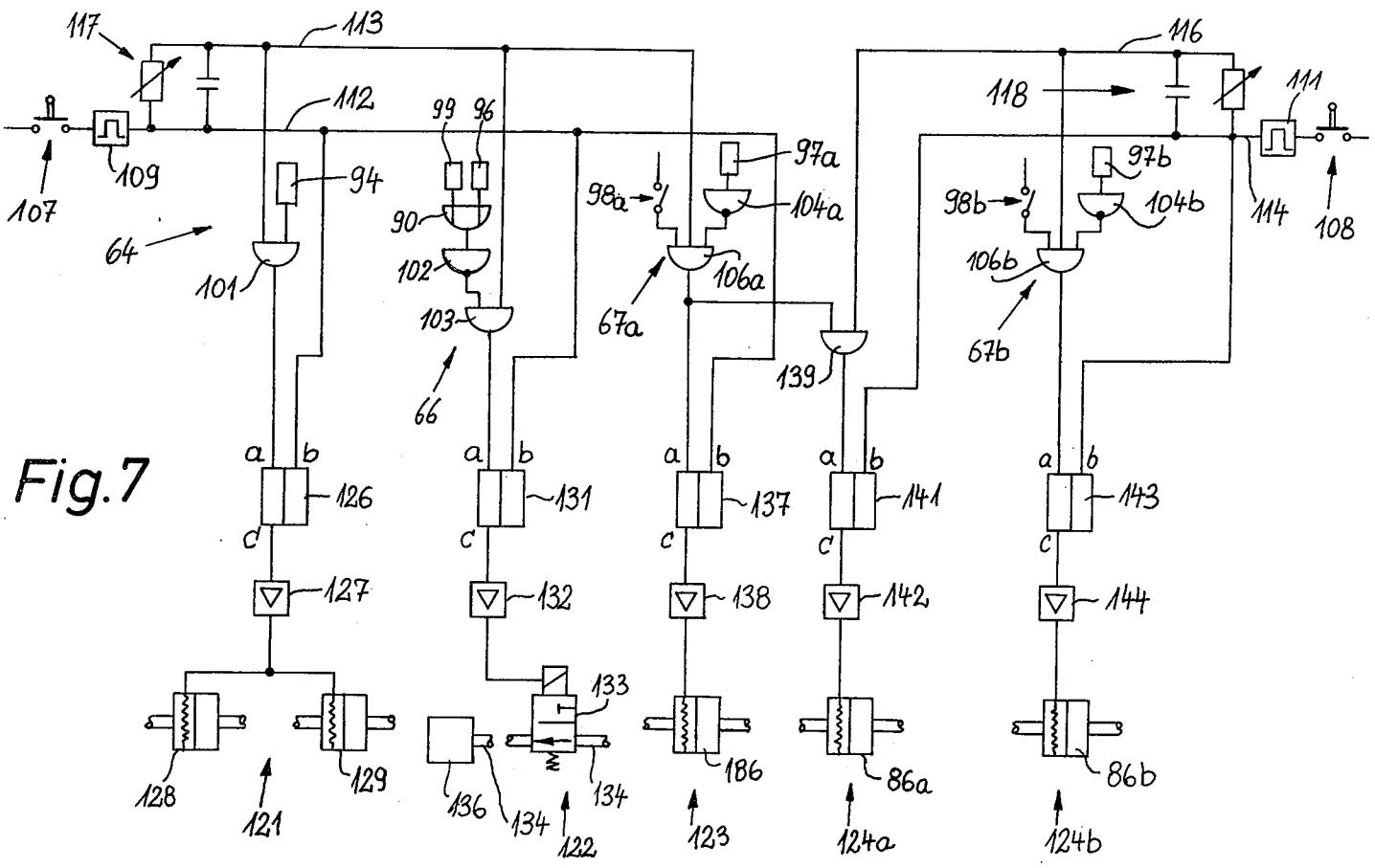
FIG. 7 is a diagram of the control circuit in the packing machine of FIGS. 1*a* and 1*b.

The construction of the blocking forming device 33*b* is identical with that of the device 33*a*. The clutch 86*b* of the block forming device 33*b* is shown in FIG. 7. The clutches 86*a*, 86*b* are energizable to thereby deactivate the respective block forming devices 33*a*, 33*b*.

The construction of the transferring device 56 (FIG. 3) is quite similar to that of the block forming device 33*a* or 33*b*. The aforementioned pusher 89 is large enough to expel a complete block 91 from the adjacent mandrel 11 and is reciprocable in directions indicated by a double-headed arrow 188. The rod for the pusher 89 is shown at 89*b*, the sleeve at 89*a*, the power train which connects the sleeve 89*a* with the intermittently rotating disk 183 at 179, 181, 182, the drive for the disk 183 at 187, the clutch at 186, and the belt transmission which receives motion from the prime mover 146 and rotates the input element of the clutch 186 is shown at 184. The clutch 186 can be energized to thereby deactivate the transferring device 56.

As explained above, the pusher 89 serves to transfer blocks 91 from the adjacent mandrels 11 into the registering pockets 23 whereby the blocks 91 strip the associated envelopes 92, 93 off the respective mandrels and cause them to enter the pockets 23 simultaneously with the blocks 91. The drive 187 causes the disk 183 to complete a single revolution during each interval of idleness of the turrets 9 and 22.

The detector 64 which monitors the mandrels 11 between the transfer stations A and B is shown in detail in FIG. 4. This detector comprises a reflection type photoelectric cell 94 having a light source and a photosensitive transducer. The light source directs a beam of light against a mirror 95 whereby the mirror reflects the light beam and the latter impinges upon the light-sensitive surface of the transducer of the cell 94. The cell 94 then produces a signal which is indicative of the absence of a block 91 in the mandrel 11 dwelling at the monitoring station of FIG. 4 (one step ahead of the transfer station B) while the turret 9 is at a standstill. If the mandrel 11 is filled, the light beam does not reach the mirror 95 and the signal (or the absence of signal) from the transducer of the cell 94 is indicative of the fact that the mandrel 11 contains a block 91 of twentyone cigarettes Z.

The detector 94 is also capable of detecting the presence of an envelope 92 on the mandrel 11 which is located between the cell 94 and mirror 95. The metallic material of the envelope 92 reflects light in the same way as the mirror 95. If the mandrel 11 which is located between the cell 94 and mirror 95 carries a deformed blank 92*a*, such blank is closed at one end (i.e., it forms an envelope 92) because it has been treated during travel past the devices 12–14 and 16 during preceding revolution of the respective mandrel.

The detector 66 of FIG. 5 includes a photoelectric cell 96 which is identical with or analogous to the cell 94 of FIG. 4 and produces signals when the light beam issuing from its light source impinges upon and is reflected by a partially completed metallic envelope on the mandrel 11 which dwells in a position of register with the detector 66 two steps ahead of the transfer station C. A second reflection type photoelectric cell 99 of the detector 66 is adjacent to one end of the mandrel 11 to produce a signal when the light beam issuing from its light source is reflected by the closed end of a finished envelope 92. The light beam issuing from the light source of the cell 96 is reflected by a side panel of a blank 92*a* which has been converted into a tube but is not as yet closed at one end. The position of the cell 96 of FIG. 5 is selected in such a way that the light beam issuing from its light source cannot be reflected by the adjacent mandrel 11 (the mandrel is too short) but that the light beam is relfected by one end of a tube which constitutes an intermediate stage of conversion of a blank 92*a* into an envelope 92. The signals from the cell 99 are indicative of a defect, i.e., that the mandrel 11 carries a finished envelope 92 which means that the conversion of a blank 92*a* into an envelope 92 has been completed during the preceding revolution of the turret 9. The signals from the cell 96 are indicative of the presence of a partially deformed blank 92*a* which is about to be converted into an envelope 92.

The detector 67*a* of FIG. 6 is analogous to or identical with the detector 67*b*. It comprises a photoelectric cell 97*a* (FIG. 7) having a light source 97*a'* and a transducer 97*a''*. When the light beam issuing from the source 97*a'* reaches the transducer 97*a''*, the mandrel 11 which is located between 97*a'* and 94*a''* is empty (i.e., it does not contain a block 91) and the mandrel also does not carry an envelope 92 and/or 93.

The detector 67*a* further comprises a scanning device 98*a* having two contacts 98', 98''. The contacts 98', 98'' complete a path for the flow of electric current when they engage a mandrel 11 (which is assumed to consist of or to be coated with a metallic material) or a metallic envelope 92. However, the path for the flow of current remains open if the contacts 98', 98'' engage an envelope 93 which consists of paper.

FIG. 7 illustrates the details of a control circuit of the packing machine. This circuit insures that the detectors 64, 66, 67*a* and 67*b* can regulate the operation of the packing machine so to reduce the likelihood of wasting blocks 91, blanks 92*a* and envelopes 92 and/or blanks 93*a* and envelopes 93. The signals from detectors 64, 66, 67*a* and 67*b* influence the operation of feeding units 3, 4, 6 and of the transferring device 56.

The photoelectric cell 94 of the detector 64 forms part of a first section 121 of the control circuit and serves to transmit signals to one input of an AND-gate 101. The photoelectric cells 96, 99 of the detector 66 transmit signals to the corresponding inputs of an OR-gate 90 in a second section 122 of the control circuit. The output of the OR-gate 90 is connected with the input of a NO-gate 102, and the output of the NO-gate 102 is connected with one input of an AND-gate 103.

The output of the photoelectric cell 97*a* of the detector 67*a* transmits signals to a NO-gate 104*a* in a third section 123 of the control circuit. The output of the NO-gate 104*a* is connected with one input of an AND-gate 106*a* the other input of which is connected with and receives signals from the scanning device 98*a* when the contacts 98*a'*, 98*a''* of the device 98*a* are electrically connected to each other by a mandrel 11 or by an envelope 92.

The detector 67*b* is installed in a portion 124*b* of a fourth section of the control circuit. The output of the photoelectric cell 97*b* of the detector 67*b* transmits signals to the input of a NO-gate 104*b* whose output is connected with one input of an AND-gate 106*b*. The other input of the AND-gate 106*b* is connected with the scanning device 98*b* of the detector 67*b* and receives a signal when the contacts of the device 98*b* are electrically connected to each other by a mandrel 11 or by an envelope 92.

Figure 8:
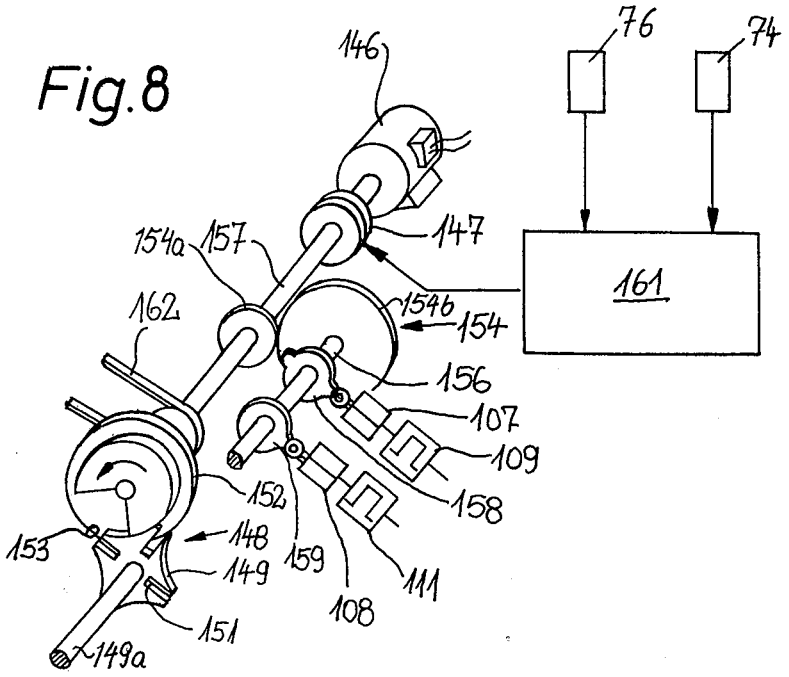
* and FIG. 8 is a perspective view of the prime mover and certain other parts of the packing machine.

The control circuit of FIG. 7 further comprises two normally open electric switches 107, 108 which are closed at certain intervals (always prior to completion of an interval of idleness of the turret 9) by cams 158, 159 shown in FIG. 8. The switches 107, 108 are respectively connected with pulse shapers 109, 111. The switch 107 is closed after each interval of idleness of the turret 9, and the switch 108 is closed after each second interval of idleness of the turret 9. The closing of switch 107 results in activation of certain sections of the control circuit, and the closing of switch 108 results in activation of the remaining sections.

The output of the pulse shaper 109 transmits signals via two conductors 112, 113 the latter of which contains a time-delay device 117 (e.g., an RC-link). Analogously, the output of the pulse shaper 111 transmits signals to conductors 114, 116 the latter of which contains a timedelay device 118. The conductors 112, 113 are connected with certain elements of the sections 121, 122, 123 and the conductors 114, 116 are connected with certain elements of portions 124*a*, 124*b* of the fourth section of the control circuit.

The control circuit section 121 regulates the operation of the feeding unit 4, the section 122 regulates the operation of the feeding unit 6, the section 123 regulates the operation of a transferring device 56, and the portions 124*a*, 124*b* respectively regulate the operation of block forming devices 33*a*, 33*b* in the feeding unit 3.

The section 121 of the control circuit further comprises a signal storing device 126 (e.g., a circuit of the type known as flip-flop) having a setting input *a* which is connected to the output of the AND-gate 101 and an erasing input *b* connected to the conductor 112. The output *c* of the signal storing device 126 is connected with an amplifier 127 which can energize two electromagnetic clutches 128, 129. When the clutch 129 is not energized, it connects the blank supplying device 44 of the feeding unit 4 with the prime mover 146. Analogously, when the clutch 128 is deenergized, it connects the prime mover 146 with the advancing rolls 43 of the feeding unit 4. Energization of the clutches 128, 129 results in deactivation of the feeding unit 4. The other input of the AND-gate 101 in the section 121 is connected with the conductor 113.

The other input of the AND-gate 103 in the section 122 of the control circuit is connected with the conductor 113. The output of the AND-gate 103 is connected with the setting input *a* of a signal storing device 131 whose other input *b* (erasing input) is connected to the conductor 112. The output *c* of the signal storing device 131 is connected with an amplifier 132 which can energize the solenoid of a valve 133. The valve 133 is mounted in a conduit 134 which connects the suction wheel 48 with a suction generating device 136. The valve 133 is open when its solenoid is not energized. Thus, when the output *c* of the signal storing device 131 transmits a signal to the amplifier 132, the valve 133 closes and thereby deactivates the feeding unit 6 because the suction wheel 48 cannot transport blanks 93*a* to the drum 49.

The section 123 of the control circuit further comprises a signal storing device 137 having a setting input *a* which is connected with the output of the AND-gate 106*a* and an erasing input *b* connected to the conductor 112. The output *c* of the signal storing device 137 is connected with an amplifier 138 which can energize the electromagnetic clutch 186 (see also FIG. 3). When the clutch 186 is disengaged (deenergized), the belt transmission 184 of FIG. 3 can transmit torque to the input element of the drive 187 for the disk 183. Thus, the transferring device 56 is ready to operate when the output *c* of the signal storing device 137 does not transmit a signal to the amplifier 138.

The portion 124*a* of the fourth section of the control circuit comprises an AND-gate 139 one input of which is connected with the output of the AND-gate 106*a* in the control circuit section 123 and the other input of which is connected with the conductor 116. The output of the AND-gate 139 is connected with the setting input *a* of a signal storing device 141 which has an erasing input *b* connected to the conductor 114 and an output *c* connected with an amplifier 142. The amplifier 142 can energize the electromagnetic clutch 86*a* (see also FIG. 2) between the belt transmission 84 and drive 87. The drive 87 is ready to rotate the disk 83 at predetermined intervals when the clutch 86*a* is deenergized.

The portion 124*b* of the fourth control circuit section comprises a signal storing device 143 having a setting input *a* connected to the output of the AND-gate 106*b*, an erasing input *b* connected to the conductor 114, and an output *c* connected to an amplifier 144 which can energize the clutch 86*b* of the block forming device 33*b*. The block forming device 33*b* is deactivated in response to energization of the clutch 86*b*.

It will be noted that the switch 108 controls the block forming devices 33*a*, 33*b*. This is necessary because the devices 33*a*, 33*b* assemble blocks 91 during each second interval of idleness of the flexible element 29.

FIG. 8 shows the prime mover 146 which is an electric motor arranged to rotate a main drive shaft 157 through the medium of the clutch 147. The shaft 157 drives a Geneva movement 148 including a disk 152 having a pin 153 cooperating with a wheel 149 having radial slots 151. The wheel 149 drives a shaft 149*a* which transmits motion to the turrets 7, 8, 9, 22 and one or both sprocket wheels or pulleys 27, 28 for the flexible element 29. In a manner which is well known from the art, the disk 152 rotates the wheel 149 while the pin 153 extends into a slot 151, and the wheel 149 is at a standstill while the pin 153 moves about the axis of the shaft 157 to enter the next slot 151. Each stage of operation of the packing machine includes an interval of movement (the pin 153 extends into one of the slots 151) and the next-following interval of idleness of the shaft 149*a*.

FIG. 8 shows the Geneva movement 148 in a condition it assumes immediately prior to start of a new stage. The pin 153 is about to enter the slot 151 at the 10 o'clock position.

A step-down transmission 154 (including a smaller friction wheel 154*a* on the main drive shaft 157 and a larger friction wheel 154*b* driven by the wheel 154*a*) drives a camshaft 156 for the aforementioned cams 158, 159. The cam 158 has two lobes each of which can close the switch 107, and the cam 159 has a single lobe which can close the switch 108. The ratio of the step-down transmission 154 is such that the RPM of the camshaft 155 is half the RPM of the main drive shaft 157.

A regulating circuit 161 is connected with the detectors 74, 76 and serves to disengage the clutch 147 (i.e., to disconnect the prime mover 146 from the moving parts of the packing machine) with a certain (preferably adjustable) delay following a signal from 74 or 76.

A toothed belt transmission 162 is driven by the main drive shaft 157 and serves to transmit motion to certain parts of the packing machine. These parts include the belt drives 84, 184 respectively shown in FIGS. 2 and 3.

THE OPERATION

During each second interval of idleness of the turrets of the packing machine, each of the devices 33*a*, 33*b* introduces a block 91 of twentyone cigarettes Z into the adjacent receptacle 31 of the endless flexible element 29. Before a filled receptacle 31 reaches the compacting turret 38, its contents are examined for the number of cigarettes and for the density of tobacco-containing ends by the testing unit 36. If the testing unit 36 detects one or more defective cigarettes or the absence of one or more cigarettes, the respective block is expelled from its receptacle 31 by the ejecting unit 37. Satisfactory blocks 91 are permitted to advance beyond the ejecting unit 37 and are accepted by the turret 38 in order to be compacted and shaped so that they can readily enter the mandrels 11. The manner in which the blocks 91 are introduced into the pockets of the turret 38 and thereupon into empty mandrels 11 of the turret 9 is disclosed in detail in the U.S. Pat. No. 3,750,676 to Kruse et al. For example, a first pusher can expel a satisfactory block from the foremost filled receptacle 31 into a first pocket of the turret 38 while a second pusher expels a compacted block from the other pocket of the turret 38 into the registering mandrel 11 of the turret 9.

The turret 9 rotates stepwise in a counterclockwise direction, as viewed in FIG. 1*a*, and the blank supplying device 44 places a fresh tinfoil blank 92*a* in front of a filled mandrel 11 at the transfer station B while the turret 9 is at a standstill. The device 44 is oscillatable between the first end position (shown by solid lines) in which it holds the leader of the web 45 at the left-hand side of the severing device 46, and a second end position (shown by broken lines) toward which it moves prior to severing of the web 45 by the device 46 so that the freshly formed tinfoil blank 92*a* is automatically disposed in front of the mandrel 11 at the transfer station B. A blank 92*a* which has been placed in front of the mandrel 11 at the transfer station B is held against slippage relative to such mandrel by suitable retaining means which is not shown in the drawing but is fully disclosed in the patent to Kruse et al. The draping, tucking and folding devices 12, 13, 14 and 16 thereupon treat the thus transferred blank 92a to convert it into an open-ended inner envelope 92. The devices 12–14 and 16 may treat the blank 92*a* during intervals of movement and/or during intervals of idleness of the turret 9. They perform the functions of first draping the blank 92*a* around the respective mandrell 11 to convert it into a tube having a rectangular cross-sectional outline and being open at both ends, and of thereupon closing one end of the tube by tucking in the narrower portions of the tube at the one end and by finally folding the relatively wide flaps over the tucked-in portions.

When a mandrel 11 reaches the transfer station C, it contains a block 91 of twentyone cigarettes Z and is surrounded by an inner envelope 92 consisting of tinfoil and being open at one end. The blank supplying device 54 thereupon places a paper blank 93a in front of the mandrel 11 at the station C, and the paper blank is engaged and held by the aforementioned retaining devices which are disclosed in the patent to Kruse et al. The blank 93*a* is thereupon treated by the devices 17, 18, 19, 21, 22 during the next four intervals of movement and idleness of the turret 9 whereby the devices 17, 18 convert the paper blank into a tube which surrounds the inner envelope 92 and is open at both ends. The overlapping marginal portions of the tube adhere to each other because the corresponding part of the blank 93*a* has been coated with adhesive by the applicator 52 of the paster 51. The devices 19 and 21 thereupon close the paper tube at one end (preferably in the same way as described for the closing of one end of the tinfoil tube which has been converted into the inner envelope 92) so that the closed end of the resulting outer envelope 93 is outwardly adjacent to the closed end of the respective inner envelope 92.

When a mandrel 11 which contains a block 92 and is surrounded by a partly finished container including an inner envelope 92 and an outer envelope 93 reaches the transfer station D, the respective block 92 is expelled by the pusher 89 (FIG. 3) which enters that end of the mandrel 11 which is remote from the closed ends of the respective envelopes 92, 93. As the pusher 89 penetrates into the mandrel 11 (by moving in a direction to the left, as viewed in FIG. 3), it causes the front ends of the cigarettes to bear against the closed end of the inner envelope 92 whereby the block 91 strips the respective envelopes 92, 93 off the mandrel 11 and introduces the resulting partially finished pack (one end of which is still open) into the registering pocket 23 of the turret 22.

Each partially finished pack which has been transferred into a pocket 23 rotates with the turret 22 (in stepwise fashion) through an angle of approximately 540 degrees (in a clockwise direction, as viewed in FIG. 1*a*) whereby the pack moves into register with and thereupon beyond the deforming devices 24, 26 which close the open ends of the respective envelopes 92, 93 in a manner as described in connection with the devices 14, 16. The devices 24 and 26 can simultaneously fold selected portions of both envelopes by first tucking in the narrower sides and by thereupon folding the larger flaps which overlie the tucks and one of which overlies the other. The ends of the resulting finished pack 300 remain closed because the inner sides of the outer paper flaps at both ends of the pack have been coated with adhesive by the applicator 52 during transport of the respective paper blank 93a along the paster 51.

The relatively long-lasting transport of partly finished packs and packs 300 in the pockets 23 of the turret 22 is desirable and advantageous because the adhesive on selected portions of the outer envelopes 93 has ample time to set. The inner envelope need not be coated with adhesive because it consists of a metallic material which retains its shape in respone to draping, folding and tucking, and also because the inner envelope 92 is completely surrounded by the outer envelope 93.

A finished (but still unlabelled) pack 300 is transferred into a socket 58 of the turret 7 when it reaches (for the second time) the transfer station E. The transfer is effected by the device 57. As it enters the adjacent socket 58, the pack 300 pushes against and deforms the respective revenue label 50 which overlies the socket 58 and whose end portions are attracted to the periphery of the turret 7 by suction. The outer side of the label 60 has been coated with adhesive by the applicator 62*a* of the paster 62 so that the attachment of label 60 to the pack 300 is completed as soon as the pack is properly received in the respective socket 58. The arm 61 is caused to withdraw the lowermost label 60 from the magazine 59 and to place such label across the open outer side of the adjacent empty socket 56 only if the corresponding pocket 23 of the turret 22 contains a pack 300. Such monitoring of the turret 22 is effected by the detector 68.

The turret 7 rotates clockwise, as viewed in FIG. 1*a*, and transfers successive labelled packs 400 into the slots 8*a* of the turret 8. The latter turns each labelled pack 400 through an angle of 90° and thereupon discharges the thus reoriented pack onto a belt or another suitable take-off conveyor, not shown.

The aforedescribed detectors are designed to produce signals in response to malfunctioning of the corresponding parts, devices or units. As long as the blocks 91 are properly formed by the devices 33*a* and 33*b*, as long as such blocks contain satisfactory cigarettes, as long as the units 4 and 6 feed satisfactory blanks 92*a*, 93*a*, and as long as the devices 12–14, 16–19 and 21 properly treat the blanks 92*a*, 93*a* during travel with the respective mandrels 11, the block forming devices 33*a*, 33*b*, the advancing rolls 43, the blank supplying device 44 and the transferring device 56 receive motion at preselected intervals through the medium of the respective clutches 86*a*, 86*b*, 128, 129 and 186 because these clutches are then deenergized so that they can transmit motion from the main prime mover 146. Also, the solenoid-operated valve 133 connects the suction ports of the wheel 48 with the suction generating device 136.

If the series of cigarette blocks 91 in the path $V_1$ has a gap, for example, because the ejecting unit 37 has been actuated in response to a signal from the testing unit 36 and has expelled a block 91 with one or more defective cigarettes (or a block which did not contain a requisite number of cigarettes) from the respective receptacle 31, the corresponding mandrel 11 of the turret 9 remains empty because the turret 38 failed to introduce into its interior a compacted block 91. The detector 64 monitors successive mandrels 11 of the turret 9 in a manner as described in connection with FIG. 4 and the transducer of its cell 94 transmits a signal to the corresponding input of the AND-gate 101 shown in FIG. 7. The cell 94 cooperates with the mirror 95 to detect the absence of a block 91 in the adjacent mandrel 11 during an interval of idleness of the turret 9. After elapse of such interval, one lobe of the cam 158 shown in FIG. 8 actuates the switch 107 so that the pulse shaper 109 immediately transmits an erasing signal to the inputs *b* of the signal storing devices 126, 131 and 137 (via conductor 112. This causes the signals at the outputs *c* of the signal storing devices 126, 131 and 137 to disappear (such erasure of signals at the outputs *c* of 126, 131, 137 takes place prior to each indexing of the turrets 9 and 22 in order to insure that each of these signal storing devices assumes a starting condition prior to generation of signals by the detector 64, 66, 67*a* and/or 67*b*). The signal from the switch 107 is delayed by the time-delay device 117 so that its transmission to the corresponding inputs of the AND-gates 101, 103 and 106*a* takes place with a preselected delay following the transmission of signals to the erasing inputs *b* of the signal storing devices 126, 131, 137 via conductor 112. The signals to AND-gates 101, 103 and 106*a* place the respective detectors 64, 66 and 67*a* into a condition of readiness. Since the other input of the AND-gate 101 simultaneously receives a signal from the transducer of the photoelectric cell 94 (which has detected the presence of an empty mandrel 11), the AND-gate 101 transmits a signal to the input *a* of the signal storing device 126 whereby the output *c* of this device transmits a signal to the amplifier 127 which energizes the clutches 128 and 129. Consequently, the advancing rolls 43 and the blank supplying device 44 remain idle during the next stage of operation of the packing machine because their drives are disconnected from the prime mover 146. Thus, the empty mandrel 11 does not receive a tinfoil blank 92*a* during travel past the transfer station B. This will be readily understood since, when the clutch 128 is deenergized, the rolls 43 advance a selected length of the web 41*a* toward the station B and the device 44 can move to the broken-line position of FIG. 1*a* only when the clutch 129 is deenergized. Such movement of the device 44 is necessary in order to place a fresh blank 92*a* in front of the mandrel 11 at the station B while the turret 9 is idle.

When the interval of the idleness of the turret 9 has expired (while the empty mandrel 11 was located at the transfer station B), the other lobe of the cam 158 causes the switch 107 to transmit a signal to the pulse shaper 109 and the latter transmits a signal to the erasing inputs *b* of the signal storing devices 126, 131, 137. Consequently, the signal at the output *c* of the signal storing device 126 disappears, the clutches 128, 129 are deenergized, and the advancing rolls 43 and the blank supplying device 44 are again free to operate normally, i.e., the device 44 is again in a position to place a fresh blank 92*a* in front of the next-following mandrel 11 which dwells at the transfer station B (provided that such mandrel contains a block 91).

The empty mandrel 11 thereupon advances toward the detector 66 which detects the absence of inner envelope 92 in a manner as described in connection with FIG. 5, i.e., the transducers of the cells 96 and 99 fail to receive light which is reflected by the metallic material of a partially completed inner envelope. Consequently, the NO-gate 102 of FIG. 7 transmits a signal to the corresponding input of the AND-gate 103 (the NO-gate 102 transmits a signal because neither input of the OR-gate 90 receives a signal and, consequently, the input of the gate 102 does not receive a signal from 90) which transmits a signal to the input *a* of the signal storing device 131 as soon as the other input of the AND-gate 103 receives a signal via conduit 113. The output *c* of the signal storing device 131 transmits a signal to the amplifier 132 which energizes the solenoid of the valve 133 whereby the latter disconnects the ports of the suction wheel 48 in the feeding unit 6 from the suction generating device 136. Thus, the wheel 48 cannot withdraw a blank 93*a* from the magazine 47 and the device 54 does not supply a blank 93*a* in front of the empty mandrel 11 when the latter reaches the transfer station C. Thus, the empty mandrel 11 advances beyond the station C without carrying along a blank 93*a*.

The empty mandrel 11 then advances toward the transfer station D and moves into register with the detector 67*a* during the last interval of idleness of turret 9 prior to advancing the empty mandrel all the way to the station D. The scanning device 98*a* of the detector 67 detects the absence of envelopes on the empty mandrel (because the contacts 98′, 98″ are free to engage the metallic material of the mandrel and thus complete a path for the transmission of a signal to the corresponding input of the AND-gate 106*a*). At the same time, the photoelectric cell 97*a* detects the absence of a block 91 in the mandrel 11 and, as a result of such detection, transmits a signal to the input of the NO-gate 104*a*. Consequently, the output of the NO-gate 104*a* does not transmit a signal to the second input of the AND-gate 106*a*. The third input of the gate 106*a* thereupon receives a delayed signal from the switch 107 (via time-delay device 117 and conductor 113); however, the output of the gate 106*a* cannot transmit a signal to the input *a* of the signal storing device 137. Consequently, the clutch 186 remains deenergized and the transferring device 56 remains connected with the prime mover 146 to perform a working stroke when the empty mandrel 11 reaches the transfer station D. Such stroke does not result in transfer of a partly finished pack into the registering pocket 23 of the turret 22 because the mandrel 11 is empty.

Due to the failure of device 56 to transfer a pack into the corresponding pocket 23 of the turret 22 (i.e., into the pocket which was in register with the empty mandrel 11 at the station D), an empty cell 23 reaches the transfer station E after it completes a stepwise travel along an angle of 540°. The presence of empty cell 23 is detected by the detector 68 which prevents the arm 61 from removing a label 60 from the magazine 59 so that the socket 58 which was to receive a finished pack from the empty cell 23 is not overlapped by an adhesive-coated label when it reaches the transfer station E (to register with the empty pocket 23).

It is now assumed that the mandrel 11 which reach the transfer station A receive satisfactory blocks 91 and that the transfer unit 4 has failed to supply a blank 92*a* in front of a filled mandrel 11 which reaches the station B. Such failure of the feeding unit 4 to deliver a blank 92*a* may be due, for example, to jamming of the web 45 in the guide 43*a*. It is further assumed that the block 91 which is confined in the mandrel 11 dwelling at the station B when the device 44 fails to supply a blank 92*a* has been assembled by the block forming device 33*b*.

The filled mandrel 11 (which does not carry a blank 92*a*) advances toward the transfer station C and is scanned by the detector 66 whose cells 96, 99 detect the absence of a partially completed metallic envelope. The detector 66 thereupoon prevents the device 54 from supplying a paper blank 93*a* into the path of the mandrel, i.e., the valve 133 is closed so that the wheel 48 does not withdraw a blank 93*a* during one stage of operation of the packing machine. The filled mandrel 11 (which does not carry an inner and/or outer envelope) thereupon advances toward and reaches the detector 67*b*. The scanning device 99*b* transmits a signal to the corresponding input of the AND-gate 106*b* because its contacts are free to engage the metallic material of the filled mandrel 11. The cell 97*b* does not transmit a signal to the NO-gate 104*b* because it has detected the block 91 in the mandrel 11. Consequently, the output of the NO-gate 104*b* transmits a signal to the corresponding input of the AND-gate 106*b*. The third input of the AND-gate 106*b* is connected with the pulse shaper 111 via time-delay device 118 and conductor 116. The pulse shaper 111 is activated in response to closing of the switch 108 which is controlled by the cam 159 having a single lobe (see FIG. 8) so that the switch 108 is actuated during each second interval of idleness of the turret 9. The transmission of a signal to the third input of the AND-gate 106*b* via conductor 116 is preceded by transmission of a signal to the erasing input *b* of the signal storing device 143 because the output of the pulse shaper 111 can transmit a signal to the device 143 without any delay (see the conductor 114). Consequently, the signal storing device 143 is in a condition of readiness to receive a signal at its input *a* in response to each closing of the switch 108 and prior to eventual reception of a signal from the output of the AND-gate 106*b*.

The gate 106*b* transmits such signal with a delay which is determined by the device 118 whereby the output *c* of the signal storing device 143 transmits a signal to the amplifier 144 which energizes the clutch 86*b*. Consequently, the block forming device 33*b* is disconnected from the prime mover 146 during the next two stages of operation of the packing machine. As mentioned above, the block forming device 33*b* is invariably idle during each second stage of operation and it assembles blocks 91 simultaneously with the device 33*a*, i.e., the device 33*a* is also idle during each second stage.

Consequently, a receptacle 31 of the endless flexible element 29 remains empty (because the block forming device 33*b* was caused to remain idle during two successive stages of operation of the packing machine). The delay is selected in such a way that the empty receptacle 31 reaches the transfer station A simultaneously with the filled mandrel 11 which has advanced beyond the transfer station D and back toward the station A. During such travel of the filled mandrel 11 toward the station D, the mandrel has advanced past the detector 67*a* which has detected the absence the envelopes 92, 93 in the same way as described above for the detector 67*b*. Consequently, the AND-gate 106*a* has transmitted a signal to the input *a* of the signal storing device 137 whose output *c* has transmitted a signal to the amplifier 138, i.e., the clutch 186 was energized and the transferring device 56 was disconnected from the prime mover 146 during the period of dwell of filled mandrel 11 (without envelopes 92, 93) at the transfer station D. This enabled the filled mandrel 11 to remain filled during travel from the station D back toward the station A and to register with the empty receptacle 31 during the period of dwell at the station A. If the cause of malfunction of the feeding unit 4 is such that it can be eliminated immediately or with a minimum of delay, the filled mandrel 11 (which has already completed the transport of a block 91 through 360° is practically certain to meet a tinfoil blank 92*a* when it reaches the transfer station B.

If the aforediscussed block 91 (in a mandrel 11 which did not receive a blank 92*a* from the blank supplying device 44) has been formed by the block forming device 33*a* of the feeding unit 3, the absence of inner envelope 92 and outer envelope 93 is detected by the detector 67*a* (not by the detector 67*b* because the latter is in a condition of readiness during each second stage of operation of the packing machine). The detector 67*a* performs the function of controlling the operation of the transferring device 56 (see the clutch 186 in the section 123 of the control system shown in FIG. 7) as well as the function of controlling the block forming device 33*a* (portion 124*a* of the fourth section of the control circuit shown in FIG. 7).

The erasing input *b* of the signal storing device 141 in the portion 124*a* receives a signal in response to each closing of the switch 108 (see the conductor 114). The conductor 116 thereupon transmits a delayed signal to the corresponding input of the AND-gate 139 (such signal is delayed by the device 118). The other input of the AND-gate 139 receives a signal when the detector 67*a* detects the absence of envelopes on the mandrel 11 which contains a block 91 formed by the device 33*a*. Such signal is transmitted by the AND-gate 106*a* simultaneously with transmission of a signal to the input *a* of the signal storing device 137 (as described above). The output of the AND-gate 106*a* then transmits a signal to the input *a* of the signal storing device 141 whose output *c* transmits a signal to the amplifier 142. The latter energizes the clutch 86*a* whereby the clutch disconnects the block forming device 33*a* from the prime mover 146 during two successive stages of operation of the packing machine. This insures that the cell 31 which registers with the filled mandrel 11 at the transfer station A does not contain a block 91.

If the feeding unit 6 fails to operate properly, e.g., due to jamming of a paper blank 93*a* in the magazine 47 during the preceding stage of operation of the packing machine, so that the supplying device 54 fails to place a blank 93*a* in front of a filled mandrel 11 at the transfer station C (such mandrel is assumed to be surrounded by an envelope 92), the absence of the paper blank 93*a* (and more particularly of an envelope 93) is detected by the detector 67*a* (or possibly by the detector 67*b*) in a manner as described above (the contacts of the sensing device 98*a* or 98*b* are electrically connected with each other by the material of the envelope 92). Consequently, the transferring device 56 is deactivated when the corresponding mandrel 11 reaches the transfer station D and the block forming device 33*a* or 33*b* is deactivated during two successive stages of operation of the packing machine so that the filled mandrel 11 (which carries a tinfoil envelope 92) can advance beyond the transfer station A without receiving a fresh block 91. Such mandrel thereupon advances into the range of the detector 64 whereby the material of the envelope 92 reflects light in the same way as the mirror 95 of FIG. 4, i.e., the detector 64 produces a signal which prevents the device 44 from supplying a fresh tinfoil blank 92*a* in front of the just discussed mandrel 11. The AND-gate 101 transmits a signal to the input *a* of the signal storing device 126 which causes the amplifier 127 to energize the clutches 128, 129 whereby the advancing rolls 43 remain idle and the blank supplying device 44 also remains idle during one stage of operation of the packing machine, namely during that stage when the just discussed mandrel dwells at the transfer station B. The detector 66 thereupon detects the presence of inner envelope 92 on the oncoming mandrel 11 and causes the feeding unit 6 to supply a blank 93*a*.

Thus, the mandrel 11 is thereupon treated in the same way as the preceding and next-following mandrels and cooperates with other parts of the machine to complete the conversion of its block 91 and envelopes 92, 93 into a pack.

Instead of returning the blocks 91 (in mandrels 11 which reach the transfer station D and are not surrounded by two envelopes 92, 93) into the first path $V_1$ (by moving such blocks along the path Y), the packing machine may be provided with means for automatically expelling each block 91 which reaches the station D and whose mandrel 11 does not carry an inner envelope 92 and an outer envelope 93. However, the recirculation of blocks 91 along the path Y is preferred because it contributes to more economical operation of the packing machine since each and every block 91 which enters the path $V_1$ is invariably confined in a container, either during the first or during a next-following travel along the path $V_1$.

It is further clear that one or more turrets of the packing machine may be replaced by endless chains or belts, and that the conveyor 1 may be replaced by two discrete conveyors one of which defines the path $V_1$ and the other of which defines the path Y. The packing machine then comprises a first additional transfer device which transfers onto the other conveyor (path Y) each and every block 91 which is confined in a mandrel 11 not carrying a pair of envelopes 92, 93 and a second additional transfer device which transfers blocks 91 from the other conveyor (path Y) into a mandrel of the one conveyor (path $V_1$). The solution which is shown in the drawing is preferred at this time because it contributes to compactness and simplicity of the packing machine.

It is also within the purview of the invention to feed blanks 92*a* to the first portion of the first path $V_1$ (i.e., to the transfer station A) and to feed blocks 91 to a second portion (transfer station B) of the path $V_1$. The embodiment of FIGS. 1–8 is preferred at this time because it contributes to the simplicity of controls.

Still further, the operation of the feeding unit 6 can be controlled by the detector 64. However, such mode of controlling the operation of the packing machine is less satisfactory than the described mode (according to which the feed of blanks 93*a* is controlled by the detector 66 which monitors the path $V_1$ for the presence of blanks 92*a*) because it could happen that a block 91 would be surrounded by an outer envelope 93 but not by an inner envelope 92. Such packs would have to be discarded in their entirety.

It is also possible to employ in the control circuit of FIG. 7 one or more shift registers which serve to transport signals simultaneously with the transport of mandrels which do not contain blocks and/or which do not carry inner and/or outer envelopes. Such mode of transporting signals is reliable and renders it possible to place the detectors at any desired distance from the locus of the elements which are to be deactivated or activated in response to signals. However, the solution which is shown in the drawing is simpler and less expensive, i.e., the detectors 64, 66, etc. can be placed immediately ahead of the units which are controlled thereby so that the signals need not be transported for extended periods of time.

An important advantage of the improved control system is that it insures a more economical operation of the packing machine because no satisfactory parts (blocks 91, blanks 92*a* or 93*a* and/or envelopes 92 or 93) are ejected. Instead, the mandrels 11 which carry a block or a block and an envelope 92 merely continue to circulate along the endless path defined by the turret 9 until they meet a blank 92*a* or a blank 93*a*. If the mandrels are empty, they refuse to accept blanks 92*a* and/or 93*a*. This is in contrast to operation of conventional packing machines wherein an incomplete pack or the components of an incomplete pack are simply ejected. It has been found that savings in the material of blanks and in cigarettes invariably justify the outlay for the component parts of the control system.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by letters patent is set forth in the appended claims:

1. In a machine for transporting and manipulating commodities, particularly in a packing machine for cigarettes or analogous rod-shaped articles, a combination comprising a first conveyor defining a first path; a second conveyor defining a second path; first means for feeding a first series of first commodities into a first portion of said first path so that said first conveyor advances the commodities of said first series along said first path; second means for feeding a second series of second commodities into a second portion of said first path so that each commodity of said second series is normally paired and advances with a commodity of said first series; means for transferring successive pairs of first and second commodities from a third portion of said first path into said second path so that said second conveyor advances the thus transferred pairs along said second path; means for monitoring said first path between said second and third portions of said first path, including detector means arranged to produce signals in response to detection of unpaired commodities of one of said series; means for deactivating said transferring means in response to said signals so that said unpaired commodities are not transferred into said second path; a third conveyor defining a third path along which said unpaired commodities of said one series advance to said second portion of said first path; and means for deactivating the feeding means for said one series of commodities in response to said signals so as to provide in said one series a gap for each unpaired commodity which said third conveyor advances into said first path.

2. A combination as defined in claim 1, wherein the commodities of said one series constitute the goods to be packed and the commodities of the other of said series constitute components of containers for such goods.

3. A combination as defined in claim 2, further comprising means for monitoring said first path between said first and second portions of said first path, including detector means arranged to produce second signals in response to detection of the absence of first commodities in said first path, and means for deactivating said second feeding means in response to said second signals so that a second commodity is fed into said first path only when it meets and is paired with a first commodity.

4. A combination as defined in claim 3, further comprising means for subjecting each commodity of said other series to at least one treatment in at least one of said first and second paths.

5. A combination as defined in claim 3, wherein said goods are groups consisting of predetermined numbers of rod-shaped articles and said first feeding means comprises at least one device which assembles rod-shaped articles into said groups and drive means for said device, said first-mentioned deactivating means comprising means for arresting said drive means in response to said first-mentioned signals.

6. A combination as defined in claim 3, wherein said first and third conveyors form part of a single endless conveyor, said single endless conveyor having a set of hollow mandrels for the commodities of said one series.

7. A combination as defined in claim 6, wherein said third path extends from said third to said first portion of said first path.

8. A combination as defined in claim 6, wherein said endless conveyor includes a rotary turret.

9. A combination as defined in claim 3, wherein said one series is said first series so that said goods enter said first path ahead of the respective components.

10. A combination as defined in claim 3, further comprising third means for feeding a series of third commodities into a fourth portion of said first path intermediate said second and third portions so that each pair of said first and second commodities normally meets and advances with a commodity of said third series.

11. A combination as defined in claim 10, further comprising means for monitoring said first path between said fourth and third portions of said first path, including detector means arranged to produce signals in response to detected absence of said third commodities.

12. A combination as defined in claim 11, wherein said last mentioned monitoring means forms part of said first mentioned monitoring means.

13. A combination as defined in claim 10, wherein said third commodities constitute second components of containers for said goods, and further comprising means for monitoring said first path between said second and fourth portions including detector means arranged to produce third signals in response to detected absence of commodities of said other series, and means for deactivating the feeding means for the commodities of said third series in response to said third signals so that a third commodity is fed into said first path only when it meets a pair of first and second commodities.

14. A combination as defined in claim 3, wherein said last mentioned detector means is adjacent to and located immediately upstream of said second portion of said first path.

15. A combination as defined in claim 3, further comprising means for moving said conveyors stepwise so that first intervals of movement of said conveyors alternate with second intervals of idleness.

16. A combination as defined in claim 15, further comprising means for subjecting the components of said other series to at least one deforming treatment in at least one of said first and second paths during a period of time not longer than the combined length of a first and a second interval.

* * * * *